US006621477B1

(12) United States Patent
Inoue et al.

(10) Patent No.: US 6,621,477 B1
(45) Date of Patent: Sep. 16, 2003

(54) LIQUID CRYSTAL DISPLAY DEVICE

(75) Inventors: Mitsuo Inoue, Hyogo (JP); Masafumi Agari, Hyogo (JP); Hiroyuki Murai, Hyogo (JP); Hidetada Tokioka, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 153 days.

(21) Appl. No.: 09/708,559

(22) Filed: Nov. 9, 2000

(30) Foreign Application Priority Data

Mar. 30, 2000 (JP) ..... 2000-093248

(51) Int. Cl.[7] ..... G09G 3/36
(52) U.S. Cl. ..... 345/92; 345/90; 345/98
(58) Field of Search ..... 345/87, 92, 96, 345/95, 94, 98, 90

(56) References Cited

U.S. PATENT DOCUMENTS 4,680,580 A 7/1987 Kawahara
5,671,032 A 9/1997 Lee
6,020,870 A * 2/2000 Takahashi et al. ..... 345/92
6,075,505 A * 6/2000 Shiba et al. ..... 345/87
6,115,018 A * 9/2000 Okumura et al. ..... 345/95
6,140,990 A * 10/2000 Schlig ..... 345/92
6,266,038 B1 * 7/2001 Yoshida et al. ..... 345/92

FOREIGN PATENT DOCUMENTS

| | | |
|---|---|---|
| EP | 0 271 960 | 6/1988 |
| EP | 0 797 182 | 9/1997 |
| JP | 58-196582 | 11/1983 |
| JP | 5-119352 | 5/1993 |

OTHER PUBLICATIONS

"Thin Film Transistor For Gray Scale LCD", IBM Technical Disclosure Bulletin, vol. 33, No. 1A, Jun. 1990, p. 700.

* cited by examiner

*Primary Examiner*—Steven Saras
*Assistant Examiner*—Alecia D. Nelson
(74) *Attorney, Agent, or Firm*—Leydig, Voit & Mayer, Ltd.

(57) ABSTRACT

In a color liquid crystal display device, two capacitors are connected in parallel between a pixel signal line and an electrode of a liquid cell, or one of the capacitors is connected therebetween, or none of the capacitors are connected therebetween, in order to selectively set a potential of the electrode of the liquid crystal cell in any of four steps. Therefore, gradation display in four steps can be achieved without a digital-to-analog conversion circuit, so that the cost of the device can be reduced.

5 Claims, 4 Drawing Sheets

LIQUID CRYSTAL DISPLAY DEVICE

BACKGROUND OF THE INVENTION

1. Field of the Invention

The present invention relates to a liquid crystal display device, and in particular to a liquid crystal display device capable of gradation display.

2. Description of the Background Art

Conventionally, liquid crystal display devices for displaying a static or dynamic image have been utilized in personal computers, television receivers, portable telephones, personal digital assistants, and so forth.

FIG. 4 is a circuit diagram showing main parts of such a liquid crystal display device. In FIG. 4, the liquid crystal display includes a liquid crystal cell 30, a vertical scanning line 31, a common interconnection line 32, a horizontal scanning line 33 and a liquid crystal driving circuit 34, the liquid crystal driving circuit 34 including an N channel MOS transistor 35 and a capacitor 36.

N channel MOS transistor 35 is connected between horizontal scanning line 33 and one electrode 30*a* of liquid crystal cell 30, the gate thereof being connected to vertical scanning line 31. Capacitor 36 is connected between electrode 30*a* of liquid crystal cell 30 and common interconnection line 32. A power-supply potential VCC is applied to the other electrode of liquid crystal cell 30, and a reference potential VSS is applied to common interconnection line 32. Vertical scanning line 31 is driven by a vertical scanning circuit (not shown) and horizontal scanning line 33 is driven by a horizontal scanning circuit (not shown).

When vertical scanning line 31 is set to a level "H," N channel MOS transistor 35 is conducting, and electrode 30*a* of liquid crystal cell 30 is charged to the level of horizontal scanning line 33 via N channel MOS transistor 35. For example, the light transmittance of liquid crystal cell 30 will be minimum when electrode 30*a* is at the level "H," while the light transmittance of liquid crystal cell 30 will be maximum when electrode 30a is at a level "L." A plurality of such liquid crystal cells 30 are arranged in a plurality of rows and columns to form a liquid crystal panel, the panel displaying an image.

A conventional liquid crystal display device has been configured as described above, so that, in order to perform gradation display in one liquid crystal cell 30, an application of an analog potential corresponding to the gradation was required.

However, when an image is displayed in response to a digital image signal, a digital-to-analog conversion circuit will be required for converting a digital signal to an analog signal, leading to a problem of higher cost.

SUMMARY OF THE INVENTION

A main object of the present invention is, therefore, to provide an inexpensive liquid crystal display device capable of gradation display.

A liquid crystal display device according to the present invention includes a liquid crystal cell receiving a power-supply potential at one electrode thereof and having a light transmittance varied in accordance with a potential applied to the other electrode thereof, a variable capacitance circuit connected between a line of a first reference potential and the other electrode of the liquid crystal cell and having a capacitance value controllable in a plurality of steps, and a control circuit selectively setting the capacitance value of the variable capacitance circuit in response to an image signal to set a potential of the other electrode of the liquid crystal cell. Thus, the light transmittance of the liquid crystal cell can be varied by changing the capacitance value of the variable capacitance circuit, so that gradation display can be performed with one liquid crystal cell without adding a digital-to-analog conversion circuit, and hence the cost of the device will be reduced.

Preferably, the variable capacitance circuit includes a plurality of first capacitors each having one electrode connected to the other electrode of the liquid crystal cell, and a plurality of first switching elements connected, each at one electrode, to the other electrodes of the plurality of first capacitors, and receiving, each at the other electrode, the first reference voltage. The control circuit renders conductive or non-conductive each of the plurality of first switching elements to selectively set the capacitance value of the variable capacitance circuit. In this case, the light transmittance of the liquid crystal cell can be changed by the number of the first switching elements to be conducted.

Further, each of the plurality of the first capacitors preferably has a capacitance value different from each other. In this case, gradation display in a larger number of steps will be possible.

It is also preferable to provide a second capacitor having one electrode connected to the other electrode of the liquid crystal cell, and receiving, at the other electrode, a second reference potential. In this case, more accurate setting of the potential of the other electrode of the liquid crystal cell will be possible.

More preferably, a plurality of second switching elements connected, each at one electrode, to the other electrodes of the plurality of first capacitors and receiving, each at the other electrode, the second reference potential, and a third switching element having one electrode connected to the other electrode of the liquid crystal cell and receiving, at the other electrode, the second reference potential, are further provided. The control circuit renders conductive the plurality of second switching elements and the third switching element before setting a potential of the other electrode of the liquid crystal cell, to reset the potential of the other electrodes of the plurality of first capacitors and the other electrode of the liquid crystal cell to the second reference potential. In this case, residual charge in the first capacitors and the liquid crystal cell can be removed, so that the potential of the other electrode of the liquid crystal cell can more accurately be set.

It is also preferable to further provide a fourth switching element having one electrode connected to the other electrode of the plurality of first switching elements, and receiving, at the other electrode, the first reference potential. The control circuit renders non-conductive the fourth switching element after setting a potential of the other electrode of the liquid crystal cell to stop feeding of the first reference potential to the other electrodes of the plurality of first switching elements. This can prevent variation of the other electrode of the liquid crystal cell due to leakage current of the first switching elements.

More preferably, each of the plurality of first switching elements is a field effect transistor, and a plurality of third capacitors connected, each at one electrode, to respective input electrodes of the plurality of the field effect transistors and receiving, each at the other electrode, a third reference potential, is further provided. The control circuit charges or discharges one electrode of each of the plurality of third capacitors to renders conductive each of the plurality of field effect transistors.

Further, the liquid crystal display device is preferably installed in a portable electronic device. The present invention will be particularly advantageous in such a case.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
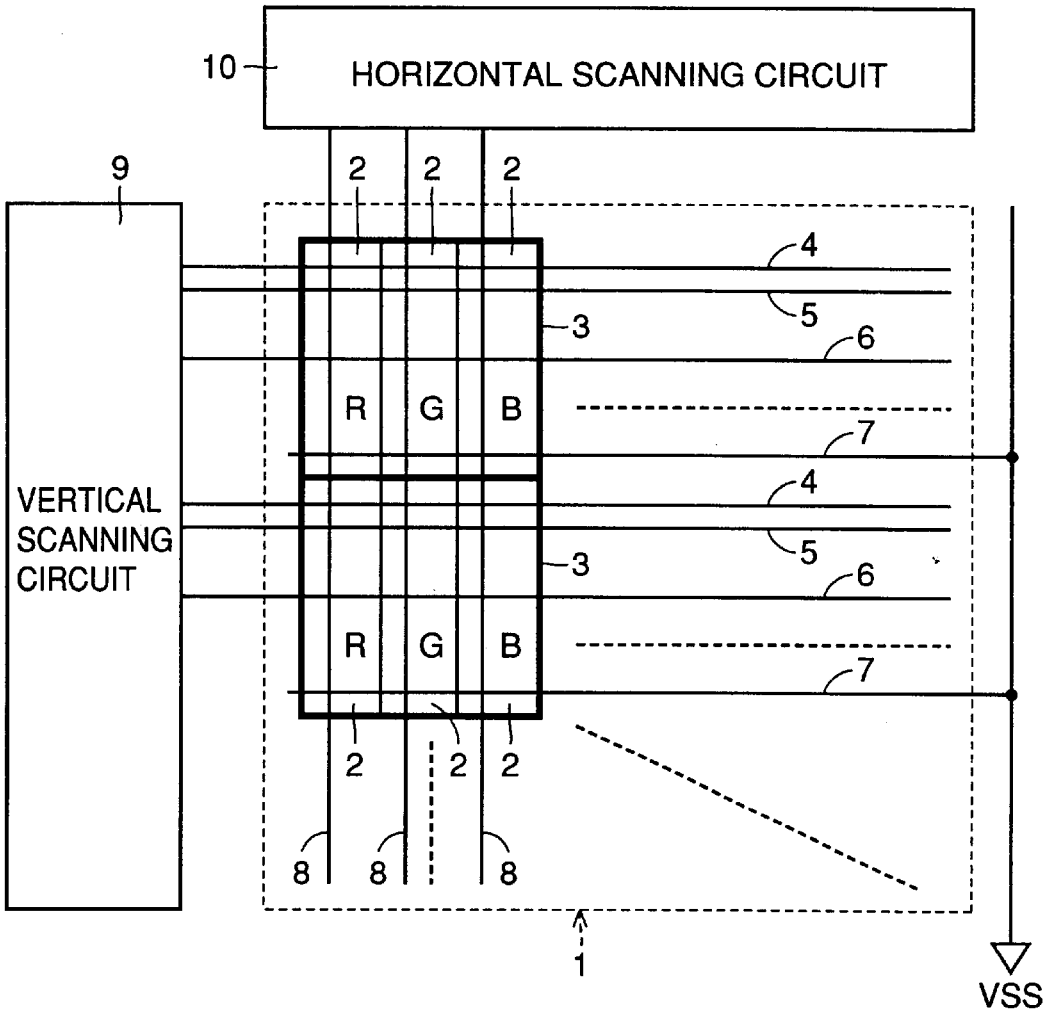
FIG. 1 is a block diagram showing a configuration of a color liquid crystal display device according to a first embodiment of the invention.

FIG. 1 is a block diagram showing a configuration of a color liquid crystal display device according to a first embodiment of the invention. In FIG. 1, the color liquid crystal display device includes a liquid crystal panel 1, a vertical scanning circuit 9 and a horizontal scanning circuit 10, and is installed, for example, in a portable telephone.

A liquid crystal panel 1 includes a plurality of liquid crystal cells 2 arranged in a plurality of rows and columns. Liquid crystal panel 1 also includes a pixel signal line 4, a first vertical scanning line 5, a second vertical scanning line 6 and a common interconnection line 7, corresponding to each of the rows, and a horizontal scanning line 8 corresponding to each of the columns.

Liquid crystal cells 2 are pre-divided into groups for each row, each of the groups including three cells. Three liquid crystal cells 2 in each group are respectively provided with color filters of R, G and B. The three liquid crystal cells 2 in each group form a pixel 3.

Vertical scanning circuit 9 sequentially selects a row, one by one from the plurality of rows, in response to an image signal, and drives each of pixel signal line 4, the first vertical scanning line 5 and the second vertical scanning line 6 corresponding to each selected row. A reference voltage VSS is applied to common interconnection line 7.

Horizontal scanning circuit 10 sequentially selects a column, one by one from the plurality of columns, in response to an image signal while vertical scanning circuit 9 is selecting a row, and drives horizontal scanning line 8 corresponding to each selected column.

When vertical scanning circuit 9 and horizontal scanning circuit 10 have scanned all of liquid crystal cells 2 in liquid crystal panel 1, an image is displayed on liquid crystal panel 1.

Figure 2:
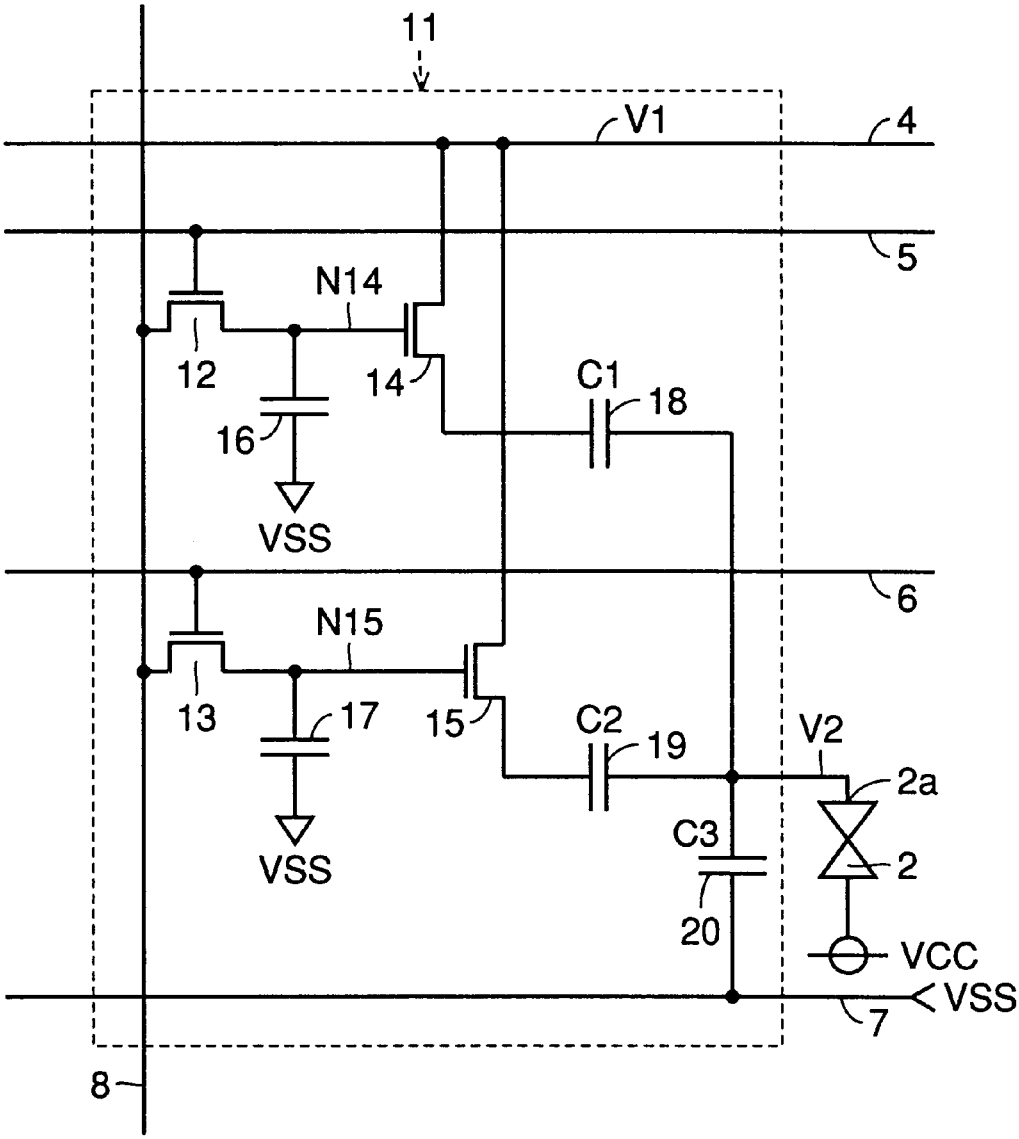
FIG. 2 is a circuit diagram showing a configuration of a liquid crystal driving circuit included in the color liquid crystal display device shown in FIG. 1.

FIG. 2 is a circuit diagram showing a configuration of a liquid crystal driving circuit 11 provided corresponding to each of liquid cells 2. In FIG. 2, liquid crystal driving circuit 11 includes N channel MOS transistors 12–15 and capacitors 16–20, and is connected to a pixel signal line 4, a first vertical scanning line 5, a second vertical scanning line 6 and a common interconnection line 7 in a corresponding row, and to a horizontal scanning line 8 in a corresponding column.

N channel MOS transistor 14 and capacitor 18 are connected in series between pixel signal line 4 and one electrode 2*a* of crystal cell 2. N channel MOS transistor 12 is connected between horizontal scanning line 8 and the gate (node N14) of N channel MOS transistor 14, the gate thereof being connected to the first vertical scanning line 5. Capacitor 16 is connected between node N14 and common interconnection line 7.

N channel MOS transistor 15 and capacitor 19 are connected in series between pixel signal line 4 and one electrode 2*a* of liquid crystal cell 2. N channel MOS transistor 13 is connected between horizontal scanning line 8 and the gate (node N15) of N channel MOS transistor 15, the gate thereof being connected to the second vertical scanning line 6. Capacitor 17 is connected between node N15 and common interconnection line 7.

Capacitor 20 is connected between electrode 2*a* of liquid crystal cell 2 and common interconnection line 7. Power-supply potential VCC is applied to the other electrode of liquid crystal cell 2. The light transmittance of liquid crystal cell 2 varies depending on a voltage between electrodes.

The operation of this liquid crystal driving circuit 11 is now described. When the first vertical scanning line 5 is set to a level "H," i.e., an activation level, N channel MOS transistor 12 is conducted and node N14 is charged to a level "H" or "L" via horizontal scanning line 8. When the second vertical scanning line 6 is set to the level "H," i.e., the activation level, N channel MOS transistor 13 is conducted and node N15 is charged to a level "H" or "L" via horizontal scanning line 8.

For example, both nodes N14 and N15 are in the level "H," N channel MOS transistors 14 and 15 are conducted and electrode 2*a* of liquid crystal cell 2 is connected to pixel signal line 4 via capacitor 18 and N channel MOS transistor 14, and also via capacitor 19 and N channel MOS transistor 15. Assuming here that the potential of pixel signal line 4 is V1, and that the capacitance value of capacitors 18–20 are C1–C3, then a potential V2 of electrode 2*a* of liquid crystal cell 2 will be $V2=V1\times(C1+C2)/(C1+C2+C3)=Va$.

If nodes N14 and N15 are in the levels "H" and "L" respectively, N channel MOS transistor 14 is conducted while N channel MOS transistor 15 is non-conducted, and electrode 2*a* of liquid crystal cell 2 is connected to pixel signal line 4 via capacitor 18 and N channel MOS transistor 14 only. In this case, potential V2 of electrode 2*a* of liquid crystal cell 2 will be $V2=V1\times C1/(C1+C3)=Vb$.

If nodes N14 and N15 are in the levels "L" and "H" respectively, N channel MOS transistor 14 is non-conducted while N channel MOS transistor 15 is conducted, and electrode 2*a* of liquid crystal cell 2 is connected to pixel signal line 4 via capacitor 19 and N channel MOS transistor 15. In this case, potential V2 of electrode 2*a* of liquid crystal cell 2 will be $V2=V1\times C2/(C2+C3)=Vc$.

If both nodes N14 and N15 are in the level "L," N channel MOS transistors 14 and 15 are non-conducted and capacitor 20 will not be charged, and hence, V2=0.

Here, if each of C1 and C2 is set to have a value different from each other, it will be possible to selectively set potential V2 of electrode 2*a* of liquid crystal cell 2 to any one of the potentials in four steps, i.e., Va, Vb, Vc or 0. This enables one liquid crystal cell 2 to perform gradation display in four steps. Therefore, according to the first embodiment, the gradation display can be performed without applying an analog potential to pixel signal line 4, and thus the cost of the gradation display can be reduced since no digital-to-analog conversion circuit is required.

It is noted that capacitor 20 may be dispensed with, since liquid crystal cell 2 has some capacitance. In such a case, potential V2 of electrode 2*a* of liquid crystal cell 2 is determined by potential V1 of pixel signal line 4, capacitance value C1 and C2 of capacitors 18 and 19, and the capacitance value of liquid crystal cell 2.

Second Embodiment

In liquid crystal driving circuit 11 in FIG. 2, if there is any residual charge in capacitors 18–20, potential V2 of electrode 2*a* of liquid crystal cell 2 cannot be accurately set to Va, Vb, Vc and 0 described above. The second embodiment is to solve this problem.

Figure 3:
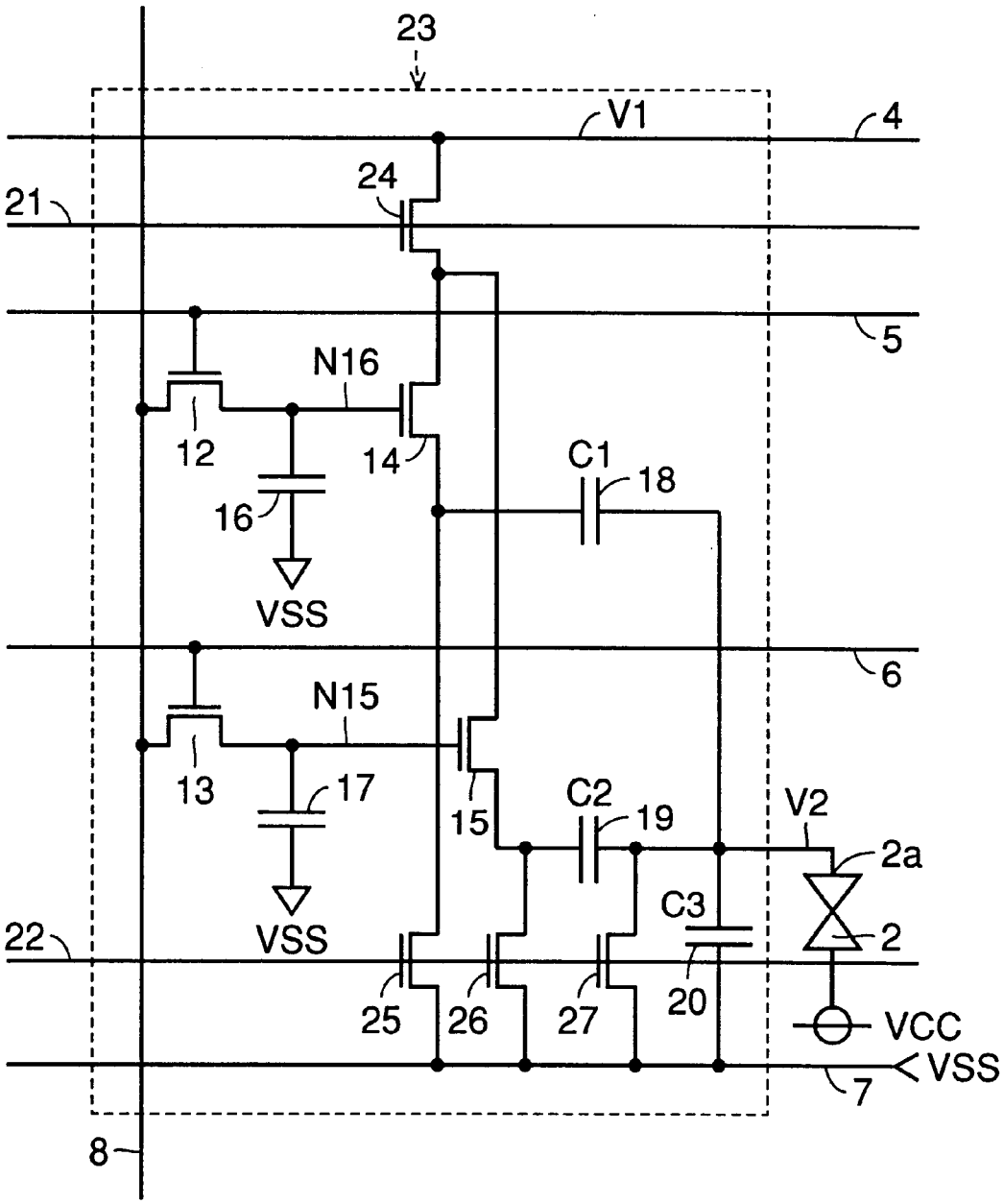
FIG. 3 is a circuit diagram showing a configuration of a liquid crystal driving circuit in a liquid crystal display device according to a second embodiment of the invention.
Figure 4:
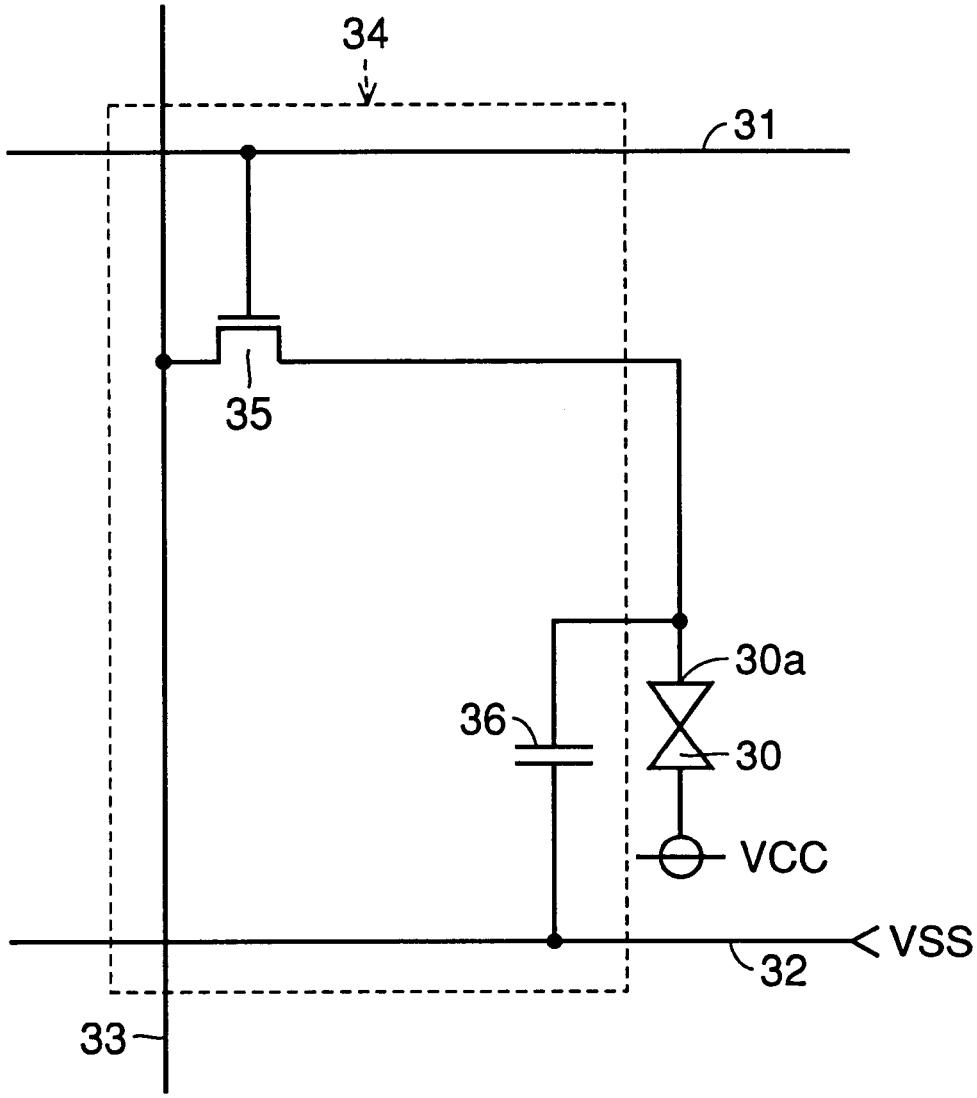
FIG. 4 PRIOR ART
FIG. 4 is a circuit diagram showing a configuration of a liquid crystal driving circuit in a conventional liquid crystal display device.

FIG. 3 is a circuit diagram showing main parts of a color liquid crystal display device according to the second embodiment. This is compared with FIG. 2.

Referring to FIG. 3, this color liquid crystal display device is different from the color liquid crystal display device in the first embodiment, in that a third vertical scanning line 21 and a fourth vertical scanning line 22 are further provided corresponding to each row, so as to replace liquid crystal driving circuit 11 with a liquid crystal driving circuit 23. Liquid crystal driving circuit 23 is different from liquid crystal driving circuit 11 in that N channel MOS transistors 24–27 are added.

N channel MOS transistor 24 is connected between pixel signal line 4 and N channel MOS transistors 14 and 15, the gate thereof being connected to the third vertical scanning line 21 in a corresponding row. N channel MOS transistor 25 is connected between the source of N channel MOS transistor 14 and common interconnection line 7. N channel MOS transistor 26 is connected between the source of N channel MOS transistor 15 and common interconnection line 7. N channel MOS transistor 27 is connected between electrode 2*a* of liquid crystal cell 2 and common interconnection line 7. Gates of N channel MOS transistors 25–27 are all connected to the fourth vertical scanning line 22.

The operation of the color liquid crystal display device is now described. First, the third vertical scanning line 21 and the fourth vertical scanning line 22 are respectively set to levels "L" and "H," and N channel MOS transistor 24 is non-conducted while N channel MOS transistors 25–27 are conducted to allow the residual charge of capacitors 18-20 to be discharged. As a result, one electrode and the other electrode of each of capacitors 18–20 are set to the same potential VSS. It is noted that N channel MOS transistor 24 is non-conducted for the purpose of preventing short-circuit between pixel signal line 4 and common interconnection line 7.

Subsequently, the third vertical scanning line 21 and the fourth vertical scanning line 22 are set to the levels "H" and "L" respectively, and N channel MOS transistors 25–27 are non-conducted while N channel MOS transistor 24 is conducted. As for the rest, electrode 2*a* of liquid crystal cell 2 is accurately set to a desired potential, i.e., Va, Vb, Vc or 0 described above, in the same manner as that of the liquid crystal display device in the first embodiment.

Finally, both the third vertical scanning line 21 and the fourth vertical scanning line 22 are set to the level "L," so that N channel MOS transistors 24–27 are non-conducted. This prevents variation of potential V2 of electrode 2*a* of liquid crystal cell 2 due to leakage of current from pixel signal line 4 to capacitors 18 and 19.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display device capable of gradation display, comprising:

a liquid crystal cell having first and second electrodes, receiving a power-supply potential at the first electrode, and having a light transmittance varying in accordance with a potential applied to the second electrode;

a variable capacitance circuit connected between a line carrying a first reference potential and the second electrode of said liquid crystal cell and having a capacitance controllable in a plurality of steps, said variable capacitance circuit including first, second, and third capacitors each having respective first and second capacitor electrodes, each of said second capacitor electrodes being connected to said second electrode of said liquid crystal cell, said first capacitor electrode of said third capacitor being connected to a second reference potential, and first and second switching elements having respective input terminals coupled to the first reference potential and respective output terminals connected to said first capacitor electrodes of said first and second capacitors, respectively;

a control circuit selectively setting the capacitance of said variable capacitance circuit in response to an image signal, thereby setting a potential of said second electrode of said liquid crystal cell, said control circuit including third and fourth switching elements having respective input terminals receiving a first scanning signal, respective output terminals connected to control terminals of said first and second switching elements, respectively, and respective control terminals receiving second and third scanning signals, respectively; and fifth, sixth, and seventh switching elements having respective control terminals receiving a fourth scanning signal, respective input terminals, said input terminals of said fifth and sixth switching elements being connected to said first capacitor electrodes of said first and second capacitors, respectively, said input terminal of said seventh switching element being connected to said second capacitor electrode of said third capacitor, and respective output terminals, said output terminals of said fifth, sixth, and seventh switching elements receiving the second reference potential, wherein said control circuit renders conductive said fifth, sixth, and seventh switching elements before setting a potential of the second electrode of said liquid crystal cell, to reset potentials of said second capacitor electrodes of said first, second, and third capacitors and of said second electrode of said liquid crystal cell to the second reference potential.

2. The liquid crystal display device according to claim 1, wherein said first, second, and third capacitors have respective, different capacitances.

3. The liquid crystal display device according to claim 1, comprising an eighth switching element having a first electrode connected to said input terminals of said first and second switching elements, said eighth switching element receiving, at a second electrode, the first reference potential, wherein said control circuit renders non-conductive said eighth switching element after setting a potential of said second electrode of said liquid crystal cell to stop feeding of the first reference potential to said input electrodes of said first and second switching elements.

4. The liquid crystal display device according to claim 1, wherein each of said first, second, third, and fourth switching elements is a field effect transistor, said device further comprising fourth and fifth capacitors, each connected, at a first electrode, to respective control terminals of said first and second switching elements, each of said fourth and fifth capacitors receiving, at a second electrode, the second reference potential, wherein said control circuit charges the first electrode of each of said fourth and fifth capacitors to render each of said first and second switching elements conductive.

5. The liquid crystal display device according to claim 1, wherein said liquid crystal display device is installed in a portable electronic device.

* * * * *